US008483600B2

(12) United States Patent
Uetake et al.

(10) Patent No.: US 8,483,600 B2
(45) Date of Patent: Jul. 9, 2013

(54) DEVELOPMENT DEVICE HAVING DEVELOPER CARRIER WITH STATIONARY DISPOSED MAGNETIC BODY

(75) Inventors: Shigeo Uetake, Takatsuki (JP); Toshiya Natsuhara, Takarazuka (JP); Junya Hirayama, Takarazuka (JP); Takeshi Maeyama, Ikeda (JP); Makiko Watanabe, Uji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 666 days.

(21) Appl. No.: 12/644,544

(22) Filed: Dec. 22, 2009

(65) Prior Publication Data

US 2010/0183343 A1 Jul. 22, 2010

(30) Foreign Application Priority Data

Jan. 20, 2009 (JP) ..... 2009-009657

(51) Int. Cl.
*G03G 15/08* (2006.01)

(52) U.S. Cl.
USPC ..... 399/281

(58) Field of Classification Search
USPC ..... 399/267, 269, 272, 281, 282
See application file for complete search history.

(56) References Cited

U.S. PATENT DOCUMENTS

| | | | | |
|---|---|---|---|---|
| 7,502,580 | B2 * | 3/2009 | Hays | 399/272 |
| 7,519,318 | B2 * | 4/2009 | Kurogawa et al. | 399/269 |
| 7,706,728 | B2 * | 4/2010 | Ramesh et al. | 399/269 |

FOREIGN PATENT DOCUMENTS

| | | |
|---|---|---|
| JP | 59-172662 | 9/1984 |
| JP | 2005-037523 | 2/2005 |

* cited by examiner

*Primary Examiner* — William J Royer
(74) *Attorney, Agent, or Firm* — Brinks Hofer Gilson & Lione

(57) ABSTRACT

Provided is a development device and an image forming apparatus that realize high image quality with improved decrease in density at high speed development and with reduced occurrence of development hysteresis (ghost) in a hybrid developing method having a plurality of toner carriers, by reducing the decrease in the toner supplying ability to a downstream-side toner carrier, which decrease is caused by the supply of toner to an upstream-side toner carrier on an upstream side in a rotating direction of a developer carrier. By providing a magnetic pole between main magnetic poles, of the developer carrier, facing the toner carriers, a magnetically raised bristle of developer is moved by a magnetic force, while the developer in which development hysteresis due to supplying toner to the upstream-side toner carrier occurred is conveyed to supply toner to the downstream-side toner carrier, whereby a developer layer is stirred.

4 Claims, 5 Drawing Sheets

DEVELOPMENT DEVICE HAVING DEVELOPER CARRIER WITH STATIONARY DISPOSED MAGNETIC BODY

This application is based on Japanese Patent Application No. 2009-009657 filed on Jan. 20, 2009, in the Japanese Patent Office, the entire content of which is hereby incorporated by reference.

TECHNICAL FIELD

The present invention relates to a development device and an image forming apparatus provided with the development device. The above-mentioned development device has the followings: a plurality of toner carriers which support toner thereon and convey the toner to develop a latent image formed on an image carrier with the toner; and a developer carrier which carries developer thereon and conveys the developer to feed toner in the developer to the plurality of toner carriers.

BACKGROUND

Conventionally, the following two methods are known as a developing method used in image forming apparatuses using the electrographic method. One is a single-component developing method which uses only toner as developer. The other is a two-component developing method which uses toner and carrier as developer.

Generally, in a single-component developing method, the toner is charged, and a desired thin toner layer is obtained by passing the toner through a regulating portion formed between the toner carrier and a regulating blade pressed against the toner carrier. With this arrangement, the single-component developing method is advantageous for simplification of apparatus, miniaturization, and cost-cutting.

On the other hand, the toner tends to be deteriorated by the strong stress at a regulating portion, and the charge-accepting ability of toner tends to reduce. In addition, the surfaces of the regulating blade and the toner carrier as a charge-providing member are contaminated with toner and additives, and this causes the reduction of the charge-providing ability. Therefore, the charge amount of toner is accordingly lowered to create issues such as fogging. For these reason, the service life of the development device is short.

When two methods are compared, in the two-component developing method, toner is mixed with carrier and is charged by triboelectric charging, thereby causing less stress. Since the area of the carrier is charged, it is not easy for the carrier to be contaminated with toner of external additives. With the result that it is advantageous for a longer service life.

However, in the two-component developing method, when the electrostatic latent image on the image carrier is developed, the surface of the image carrier is rubbed with the magnetic brush formed of a developer. As a result, the two-component developing method has a problem that the magnetic brush marks occur on a developed image. The two-component developing method has another problem that a carrier easily adheres to the image carrier, and the adhered carrier becomes an image defect.

The hybrid developing method has been disclosed (for example, refer to Japanese Laid-Open Patent Publication No. S59-172662) as a developing method that solves the problem of image defect and realizes high image quality at the same level as the one-component developing method while maintaining the advantage of a long lifetime with the two-component developing method using two-component developer. In the hybrid developing method, a two-component developer is supported on the developer carrier, and only toner is supplied to a toner carrier from the two-component developer, whereby the toner is used for development.

However, the hybrid developing method had the following problem.

(1) Reduction in Density at High-Speed Developing

There was a problem that when image formation was carried out at a high speed, the jumping of toner was not enough during the nip time, thereby causing reduction in image density.

The above-mentioned problem is in common in the non-contact single-component developing method. The typical single component developing method is used only in a low speed region since that method gives a strong stress to toner, thereby causing problems of heat generation at a regulating portion and fusion of toner. Therefore, it has not been thought as a big problem. Since the hybrid developing method does not have these restrictions, it can carry out image formation considerably at a high speed. For example, in apparatuses that have a system speed exceed to 500 mm/s, the above-mentioned problem may occur.

(2) Problem of Development Hysteresis (Ghost)

The hybrid development method has a typical problem that post-development residual toner on the toner carrier which was not used for development will appear at the next developing step on an image as development hysteresis (ghost).

The toner to be used for development is supplied in the opposing portion (toner supply area) between the developer carrier for supplying toner to the toner carrier and the toner carrier. However, the collection of the post-development residual toner is also performed in the opposing portion between the toner carrier and the developer carrier. The bias in the supply direction is applied to supply toner, but on the other hand, that bias disturbs the collection of toner, therefore the collecting capability is insufficient. As a result, unevenness of the post-development residual toner will generate a contrast in density in the following developing step.

As a countermeasure to address the density reduction at the time of high-speed development, providing two or more toner carriers is known (see, for example, Japanese Laid-Open Patent Publication No. 2005-37523). This arrangement secures an enough development time for the toner to jump, thereby securing the toner density.

According to the configuration disclosed in Japanese Laid-Open Patent Publication No. 2005-37523, two or more toner carriers cause the toner to jump a plurality of times. Therefore, even when a photoreceptor is rotating at a high speed, a toner image is certainly formed on the photoreceptor, and thereby improving the density reduction related to a higher speed. In the above-mentioned configuration, the respective toner carriers use less toner for development than in the case where a single toner carrier is used. Therefore, on the layer of the post-development residual toner on the toner carriers, there is a smaller difference between a portion where the toner was used for development and a portion where the toner was not used. Therefore, a relatively small ghost will be generated.

In the configuration disclosed in Japanese Laid-Open Patent Publication No. 2005-37523, the ghost is surely improved. However, the study of the inventors of the invention showed that the level of the improvement is not sufficient and the ghost is not controlled sufficiently.

The reason for that problem is that the toner carrier located downstream in the rotating direction of the image carrier is not supplied with sufficient toner. That is because the developer on only one developer carrier supplies toner to a plurality of toner carriers.

In order to cope with the reduction in toner supplying ability, it is possible to compensate the reduction and to control the density reduction by increasing a toner supply bias. However, if the toner supply bias is increased, the electric field to urge toner to the toner carrier, whereby the collection of the post-development residual toner is disturbed from a viewpoint of toner collection. Therefore, the occurrence of ghost is not controlled sufficiently.

SUMMARY

The present invention has been made in view of the above-mentioned technological problems. An object of the present invention is to provide a development device and an apparatus using the development device in which the decrease of image density at a high speed development and a generation of development hysteresis (ghost) are controlled. The object is realized, in the hybrid development method having a plurality of toner carriers, by controlling the reduction of a toner supplying ability in supplying toner to a toner carrier in the downstream direction, which reduction is caused by the supply of toner to a toner carrier located upstream in the rotating direction of the developer carrier.

In view of the forgoing, one embodiment according to one aspect of the present invention is a development device, comprising:

a first toner carrier and a second toner carrier which are configured to carry toner thereon and to convey the toner to develop with the toner an electrostatic latent image formed on an image carrier; and a developer carrier which is provided facing the first toner carrier and the second toner carrier and is configured to carry thereon developer which contains toner and to supply the toner in the developer to the first toner carrier and the second toner carrier, wherein the developer carrier includes:

a stationarily disposed magnetic body, the magnetic body having:

a first magnetic pole provided to be opposed to the first toner carrier;

a second magnetic pole provided to be opposed to the second toner carrier; and at least a third magnetic pole provided between the first magnetic pole and the second magnetic pole; and a sleeve roller configured to contain the magnetic body therein and to rotate to convey the developer carried thereon.

According to another aspect of the present invention, another embodiment is an image forming apparatus, comprising:

an image carrier for carrying an electrostatic latent image formed thereon; and a development device for developing the electrostatic latent image on the image carrier, the development device including:

a first toner carrier and a second toner carrier which are configured to carry toner thereon and to convey the toner to develop with the toner the electrostatic latent image on the image carrier; and a developer carrier which is provided facing the first toner carrier and the second toner carrier and is configured to carry thereon developer which contains toner and to supply the toner in the developer to the first toner carrier and the second toner carrier, wherein the developer carrier includes:

a stationarily disposed magnetic body, the magnetic body having:

a first magnetic pole provided to be opposed to the first toner carrier;

a second magnetic pole provided to be opposed to the second toner carrier; and at least a third magnetic pole provided between the first magnetic pole and the second magnetic pole; and a sleeve roller configured to contain the magnetic body therein and to rotate to convey the developer carried thereon.

DETAILED DESCRIPTION OF THE PREFERRED EMBODIMENT

One embodiment according to the present invention will be described using the accompanied drawings.

(Configuration and Operation of Image Forming Apparatus)

Figure 1:
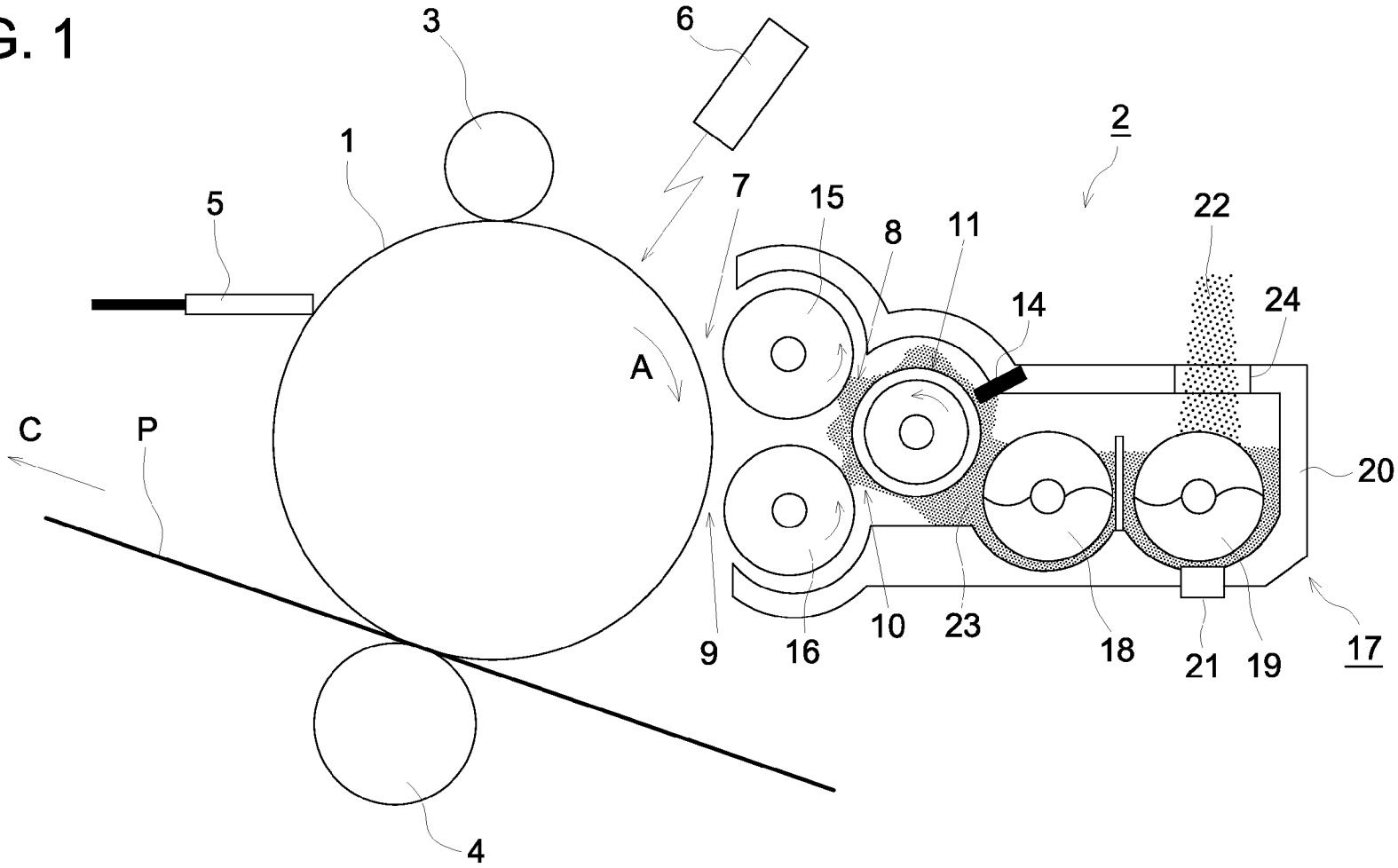
FIG. 1 is a diagram showing an example of a configuration of a main section of an image forming apparatus according to an embodiment of the present invention.

FIG. 1 shows an exemplary configuration of a major portion of an image forming apparatus of an embodiment according to the present invention. With reference to FIG. 1, a schematic configuration and an operation of the image forming apparatus according to the present embodiment will be described.

This image forming apparatus is a printer which forms an image by transferring a toner image formed by the electrographic method on an image carrier (photoreceptor) 1 onto transfer medium P such as a paper sheet.

This image forming apparatus has the image carrier 1 for supporting an image, and the following components are arranged around the image carrier 1 along a rotation direction A of the image carrier 1. A charging member 3 as a charging means for charging the image carrier 1; a development device 2 for developing an electrostatic latent image on the image carrier 1; a transfer roller 4 for transferring the toner image on the image carrier 1; and a cleaning blade 5 for cleaning residual toner on the image carrier 1.

The image carrier 1 is exposed by an exposure device 6 provided with a laser emitter after being charged by the charging member 3, and thereby forming an electrostatic latent image on the surface. The development device 2 develops this electrostatic latent image, and forms a toner image. The transfer roller 4 transfers the toner image on the image carrier 1 onto the transfer medium P, and then conveys the transfer medium P in the direction of the arrow C in the figure. The toner image is fixed by a fixing device (not shown) on the transfer medium P, and the transfer medium P is then discharged. The cleaning blade 5 removes, by a mechanical force, the residual toner remaining on the image carrier 1 after the transfer.

Any well-known electrophotographic technique can be used for the image carrier 1, charging member 3, exposure device 6, transfer roller 4, and cleaning blade 5 which are used in the image forming apparatus. For example, although a charging roller is shown as the charging means in the figure, a non-contact charging device can be used. For example, the cleaning blade 5 may not be used.

The configuration of the basic part of the development device 2, of the hybrid developing method, according to the embodiment will be described.

The development device 2 includes the following constituent elements: a developer tank 17 for containing developer 23 including carrier and toner; a developer carrier 11 for conveying on a surface thereof the developer 23 supplied from the developer tank 17; and a first toner carrier 15 and a second toner carrier 16, to which only toner is supplied from the developer carrier 11, and which develop an electrostatic latent image formed on the image carrier.

The details of the configuration and operation of the development device 2 will be described.

(Composition of Developer)

The composition of the developer used in the development device 2 according to the embodiment will be described.

The developer 23 used in the present embodiment contains toner and carrier for charging the toner.

<Toner>

As the toner, well known and generally used toners can be used without being restricted thereto, and there can be used toners made of binder resin containing colorant and, if desired, charge control agent or releasing agent, and the binder resin may be processed with external additives. The toner particle with diameter of about 3-15 μm are preferably used without being limited to this.

Such toners can be manufactured by well known and generally used methods. For example, they can be manufactured using the pulverizing method, the emulsion polymerization method, or the suspension polymerization method.

Examples of the binder resin include, for example, styrene resin (the single polymer or copolymer containing styrene or the styrene substitution product), polyester resin, epoxy system resin, vinyl chloride resin, phenol-formaldehyde, polyethylene resin, polypropylene resin, polyurethane resin, and silicone resin, without being restricted thereto. It is preferable to use one of those resins or their composition having a softening temperature of 80 to 160° C. or a glass transition point of 50 to 75° C.

As the colorants, well known and generally used ones can be used, and there can be used, for example, carbon black, aniline black, activated carbon, magnetite, benzine yellow, permanent yellow, naphthol yellow, copper phthalocyanine blue, fast sky blue, ultra marine blue, a rose bengal, or laky red, and in general, 2 to 20% by mass of those agents is preferably added to the above binder resin.

As the above charge control agents, known agents can be used, and examples of charge control agents for positive toner include, for example, nigrosine series dye, a quarternary-ammonium-salt system compound, a triphenylmethane series compound, an imidazole series compound, and polyamine resin. As the charge controlling agents for negative charge toner, examples include azo dye containing metal such as Cr, Co, aluminum, and Fe, salicylic acid metallic compounds, alkyl salicylic acid metallic compounds, and carixarene compound. Charge controlling agent in general is preferably added at a rate of 0.1 to 10% by mass with respect to the above-mentioned binder resin.

As the above releasing agents, well known and generally used agents can be used, and the examples include polyethylene, polypropylene, carnauba wax, and xazole wax, and they can be used solely or in combination of one or more of them. The releasing agent can be used at a rate of 0.1 to 10% by mass with respect to the above-mentioned binder resin.

As the above external agents, well known and generally used agents can be used, and there can be used, for example, inorganic particles, such as silica, titanium oxide, and an aluminum oxide; and resin particles, such as acrylic resin, styrene resin, silicone resin, and a fluoro-resin; and agents subjected to hydrophobing with silane coupling agent, a titanium coupling agent, or silicone oil are particularly preferable. Those plasticizers are preferably added to the above toner at a rate of 0.1 to 5% by mass. The external agents preferably have a number average particle diameter of 10 to 100 nm.

In addition, the opposite polarity particles which have a charge polarity opposite to that of toner can be used as the above external agents. The preferably used opposite polarity particles are suitably chosen depending on the charge polarity of toner.

When using negative charge toner, particles having a positive electrostatic property are used as native polarity particles, there can be used, for example, inorganic particles such as strontium titanate, barium titanate and alumina, and thermosetting resin; or thermoplastic such as acrylic resin, benzoguanamine resin, Nylon, polyimide resin, and polyamide resin. Positive charge control agent which gives a positive electrostatic property may be added to the resin, or copolymer of nitrogen-containing monomer may be composed.

As the above-mentioned positive charge control agent, nigrosine dye or quarternary ammonium salt can be used, for example. As the above-mentioned nitrogen-containing monomer, there can be used acrylic acid 2-dimethylaminoethyl, an acrylic acid 2-diethyl aminoethyl, methacrylic acid 2-dimethylaminoethyl, a methacrylic acid 2-diethyl aminoethyl, vinylpyridine, N-vinylcarbazole, or vinyl-polymers imidazole.

On the other hand, when using positive charge toner, particles having a negative electrostatic property are used as reverse polarity particles, and examples include inorganic particles such as silica and titanium oxide, and thermosetting plastic; or themoplastic such as fluoro-resin, polyolefin resin, silicone resin, and polyester resin. Negative charge control agent which gives a negative electrostatic property may be added to the resin, or the copolymer of fluorine-containing acrylic system monomer; or fluorine-containing methacrylic system monomer may be composed. As the above-mentioned negative charge control agent, there can be used, for example, chromium complex of a salicylic acid system or naphthol series; or aluminium complex, iron complex, or zinc complex.

In order to control the electrostatic property and hydrophobicity of opposite polarity particles, the surface of inorganic particles may be coated with silane coupling agent, titanium coupling agent, or silicone. When giving a positive electrostatic property to inorganic particles, the particles are preferably surface treated with amino group content coupling agent. When giving a negative electrostatic property to the inorganic particles, the particles are preferably surface treated with fluorine group content coupling agent.

A number average particle diameter of opposite polarity particles is preferably from 100 to 1000 nm, and they are added at a rate of 0.1 to 10% by mass with respect to toner.

<Carrier>

As the carrier, well known and generally used carrier can be used without being restricted thereto, and binder type carrier or coat type carrier can be used. A particle diameter is preferably from 15 to 100 μm without being restricted thereto.

The binder type carrier is a carrier in which magnetic particles are dispersed in binder resin, and the surface of the carrier may be provided with positive or negative electrostatic particles fixed thereon or provided with a surface coating layer thereon. The charging characteristics such as polarity of binder type carrier depend on material of binder resin, types of charging particles and surface coating layers.

Binder type resin used for a binder type carrier is exemplified by thermoplastic resin such as vinyl resin represented by polystyrene system resin, polyester system resin, nylon system resin, and polyolefin system resin; and thermosetting resin such as phenol resin.

As magnetic particles of the binder type carrier, there can be used spinel ferrite, such as magnetite and gamma acid-ized iron; spinel ferrite including one or more kinds of metal (Mn, Ni, Mg, Cu, etc.) except iron; magnetoplumbite type ferrite such as barium ferrite; and iron particles or alloy particles whose surface is covered with oxide. The shape of those particles may be a grain form, spherical form or needlelike form. When requiring especially high magnetization, it is preferred to use the ferromagnetic particles of an iron system. When chemical stability is taken into consideration, it is preferable to use spinel ferrite containing magnetite or gamma acid-ized iron; and ferromagnetic particles of magnetoplumbite type ferrites such as barium ferrite. By suitably choosing the type and content of ferromagnetic particles, there can be obtained the magnetic resin carrier which has desired magnetization. It is appropriate to add magnetic particles of 50 to 90% by mass into magnetic resin carrier.

As surface coat material of the binder type carrier, there can be used silicone resin, acrylic resin, epoxy resin, fluoro resin, and those resin can be coated and hardened on the surface of the carrier to form a coating layer so as to improve the charge-providing ability.

In the process of binding electrostatic particles or conductive particles onto the surface of the binder type carrier (magnetic resin carrier), for example, the magnetic resin carrier and those particles are uniformly mixed to attach those particles on the surface of the carrier, and then a mechanical or thermal shock is applied to fix those particles be driven into the magnetic resin carrier. In this case, the particles are not completely buried in the magnetic resin carrier but fixed with a part of their body extruding from the surface of the magnetic resin carrier.

As the electrostatic particles, there can be used organic or inorganic insulating material. In particular, as for organic material, there can be used particles of organic insulating material such as polystyrene, styrene system copolymer, acrylic resin, various acrylic copolymer, nylon, polyethylene, polypropylene, fluoro-resins and these bridge construction material; or a desired charging level, and polarity can be obtained depending on material and polymerization catalyst, and a surface treatment. As for inorganic material, there can be used negative charge inorganic particles such as silica and a titanium dioxide; or positive electrostatic particles such as strontium titanate and alumina.

On the other hand, the coat type carrier is a carrier in which a carrier core particle is coated with resin, and positive or negative electrostatic particles can be bonded to the surface of the coat type carrier similar to the binder type carrier. The charging properties of the coat type carrier such as polarity can be controlled by natures of surface coating layers or electrostatic particles, and material similar to the binder type carrier can be used. Especially as the coat resin, resin similar to the binder resin of the binder type carrier can be used.

The mixing ratio of the toner to the carrier may be adjusted to obtain a desired charge amount, and the mixing ratio of the toner is preferably from 3 to 50% by mass more preferably from 6 to 30% by mass with respect to the total amount of the toner and carrier.

(Configuration and Operation of Development Device 2)

Figure 7:
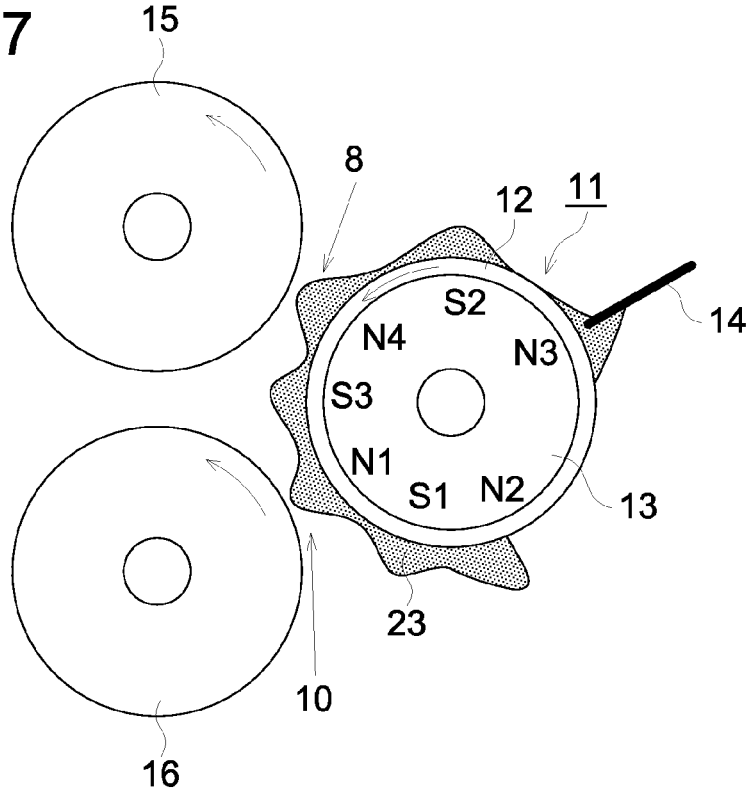
FIG. 7 is a diagram showing in detail the vicinity of toner supply areas 8 and 10 of a hybrid development device according to the embodiment.

With reference to FIGS. 1 and 7, the detailed example of the configuration and the operation of the development device 2 according to the embodiment will be described. FIG. 7 is a diagram showing the details around a toner supply area in which toner is supplied from the developer carrier 11 of the development device 2 to the toner carriers 15 and 16.

<Configuration of Apparatus>

The developer 23 to be used in the development device 2 includes toner and carrier as already mentioned, and it is stored in the developer tank 17.

The developer tank 17 is constituted of a casing 20, and usually houses agitation mix members 18 and 19. The agitation mix members 18 and 19 mix and agitate the developer 23, and supply the developer 23 to the developer carrier 11. ATDC (Automatic Toner Density Control) sensor 21 for toner concentration detection is preferably provided at the position, on the casing 20, facing the agitation mix member 19.

The development device 2 has a supply section 24 for supplying the toner to be consumed in first and second developing areas 7 and 9 to the developer tank 17. In the supply section 24, supply toner 22 is sent from a hopper (not shown) storing the supply toner 22, and is supplied to the developer tank 17.

As shown in FIG. 7, the developer carrier 11 is configured of a magnetic body 13 fixedly disposed therein and a rotatable sleeve roller 12 surrounding the magnetic body 13. The developer 23 supplied to the developer carrier 11 is held on the surface of the sleeve roller 12 by the magnetic force of the magnetic body 13 in the developer carrier 11, and is conveyed with the rotation of the sleeve roller 12.

The passing amount (amount of the developer on the developer carrier 11) of the conveyed developer 23 is controlled by a regulating member (control blade) 14 provided facing the developer carrier 11.

The magnetic body 13 has seven magnetic poles, N1, S1, N2, N3, S2, N4, and S3, along the rotational direction of the sleeve roller 12. Among these magnetic poles, a main pole N4 (first magnetic pole) is disposed in a first toner supplying area 8 facing the first toner carrier 15 in a downstream direction in the rotating direction of the developer carrier 11, and another main pole N1 (second magnetic pole) is disposed in a second toner supplying area 10 facing the second toner carrier 16 in the upstream direction.

Homopolar portions N2 and N3 which generate repulsing magnetic fields for separating the developer 23 on the sleeve roller 12 are disposed at a position facing the inside of the developer tank 17.

The magnetic pole S3 is disposed between respective main poles N4 and N1 arranged facing respective toner carriers 15 and 16. The operation and effect of the magnetic pole S3 will be described later.

The toner carriers 15 and 16 are arranged facing both of the developer carrier 11 and the image carrier 1, and a developing bias Vb for developing the electrostatic latent image on the image carrier 1 is applied from a bias power supply (not shown).

As long as the above-mentioned voltage can be applied, the toner carriers 15 and 16 can be made of any material, and examples include an aluminum roller processed with a surface treatment such as alumite. Alternately, can be used a roller made of a conductive substrate, such as aluminum, covered with resin such as polyester resin, polycarbonate resin, acryl resin, polyethylene resin, polypropylene resin, polyurethane resin, polyamide resin, polyimide resin, polysulfone resin, polyether ketone resin, vinyl chloride resin, vinyl acetate resin, silicone resin, fluoro-resin; or rubber such as silicone rubber, urethane rubber, nitrile rubber, natural rubber, and polyisoprene rubber. However, a coating material is not limited to the above.

The conductive agent may be added to the bulk or the surface of the above-mentioned coating. As a conductive agent, examples include an electronic conductive agent or an ion conducting agent. As an electronic conductive agent, examples include ketine black, acetylene black, and carbon black such furnace black, metal powder, and fine particles of metal oxide, without being restricted thereto. As an ion conducting agent, examples include a cationic compound such as quarternary ammonium salt, amphoteric compound, and other ionic-polarity polymeric materials, without being restricted thereto. The conductive roller made of metallic material such as aluminum may be used.

<Operation of Apparatus>

With reference to FIGS. 1 and 7, an operational example of the development device 2 will be described.

The developer 23 in the developer tank 17 is agitated and mixed by the agitation mix members 18 and 19, being cyclically conveyed in the developer tank 17, and is supplied to the sleeve roller 12 on the surface of the developer carrier 11.

This developer 23 is held on the surface side of the sleeve roller 12 by the magnetic force of the magnet roller 13 in the developer carrier 11, and is rotationally moved and controlled in passing amount by the regulating member 14 facing the developer carrier 11.

The developer 23 of which passing amount is regulated by the regulating member 14 is conveyed to the first toner supply area 8 facing the first toner carrier 15.

In the first toner supply area 8 in which the first toner carrier 15 and the developer carrier 11 is facing each other, a bristle of the developer 23 is formed by the main pole N4 of the magnetic body 13. The toner in the developer 23 is supplied to the first toner carrier 15 by the force that is given to the toner by the toner supply electric field formed based on the potential difference between the developing bias Vb1 applied to the first toner carrier 15 and the toner supply bias Vs applied to the developer carrier 11.

Usually, the first toner carrier 15 is applied with a bias voltage in which an AC voltage is superposed on a DC voltage. The developer carrier 11 is applied with a bias voltage of only a DC voltage or a bias voltage in which an AC voltage is superposed on a DC voltage. These bias voltages make an electric field in which an AC electric field is superposed on a DC electric field in the first toner supply area 8.

In the first toner supply area 8, the post-development residual toner on the first toner carrier 15 is mechanically scraped off by the developer 23 of the bristle on the developer carrier 11, and the post-development residual toner is collected.

The remaining developer 23 that passed through the first toner supply area 8 is rotationally moved with the rotation of the sleeve roller 12 of the developer carrier 11, and conveyed to the second toner supplying area 10 facing the second toner carrier 16 after passing through the magnetic pole S3.

Similarly to the case of the first toner supply area 8, also in this second toner supplying area 10, a bristle of the developer 23 is formed on the developer carrier 11 by the main pole N1 of the magnetic body 13. An electric field is formed based on the potential difference of the developing bias Vb2 applied to the second toner carrier 16 and the toner supply bias Vs applied to the developer carrier 11. The toner in the developer 23 is supplied to the second toner carrier 16 by the force that is given to the toner by this electric field.

Similarly to the case of the first toner supply area 8, the second toner carrier 16 is supplied with a bias in which an AC voltage is superposed on a DC voltage. The developer carrier 11 is applied with a bias voltage of only a DC voltage or a bias voltage in which an AC voltage is superposed on a DC voltage. These bias voltages make an electric field in which an AC electric field is superposed on a DC electric field in the second toner supply area 10.

Similarly to the case of the first toner supply area 8, the post-development residual toner on the second toner carrier 16 is mechanically scraped off by the developer 23 of the bristle on the developer carrier 11, and the post-development residual toner is collected.

In FIGS. 1 and 7, the rotational directions of the first toner carrier 15 and the second toner carrier 16 are set to the same direction as that of the developer carrier 11. However, the rotational directions of both toner carriers 15 and 16 may be set opposite to that of the developer carrier 11. Alternatively, one of the directions of the toner carriers 15 and 16 can be set opposite.

When they are set in an identical direction, the developer carrier 11 and the toner carriers 15 and 16 travel opposite to each other in the areas where the developer carrier 11 faces respective toner carriers 15 and 16.

In order to control the generation of development hysteresis (ghost), it is important, in the hybrid developing method, the next development is conducted in the situation where the difference of the residual toner amount is made as little as possible between a place where the toner is used for development and a place where the toner is not used, by collecting the residual toner as much as possible.

In the case where the developer carrier 11 and the toner carriers 15 and 16 travels opposite to each other in the areas where the developer carrier 11 faces respective toner carriers 15 and 16, the relative speed is higher and the mechanically correcting force is accordingly higher, thus the case has an advantage from the view point of correcting the post-development residual toner.

Therefore, it is preferable to set the rotational direction of the developer carrier 11 opposite to that of the toner carriers 15 and 16 since the development hysteresis is more effectively controlled in that case.

The toner layer supplied from the developer carrier 11 to the first toner carrier 15 in the first toner supplying area 8 is conveyed to the first developing area 7 with the rotation of the first toner carrier 15. In the first developing area 7, the first development is performed with toner transferred, through the development gap between the first toner carrier 15 and the image carrier 1, by the electric field that is formed by the developing bias Vb1 applied to the first toner carrier 15 and the latent image potential on the image carrier 1.

As the developing bias Vb1, any of various known biases is applicable, and a bias in which an AC voltage is superposed on a DC voltage is applied in general.

Then, the toner layer (post-development residual toner layer) from which toner has been consumed in the first developing area 7 is conveyed, with the rotation of the first toner carrier 15, to the first toner supplying area 8, and as mentioned above, the toner will be collected by the developer carrier 11.

In the similar manner, the toner layer supplied from the developer carrier 11 to the second toner carrier 16 is conveyed, with the rotation of the second toner carrier 16, to the second developing area 9. In the second developing area 9, the second development is performed with toner transferred, through the development gap between the second toner carrier 16 and the image carrier 1, by the electric field that is formed by the developing bias Vb2 applied to the second toner carrier 16 and the latent image potential on the image carrier 1.

As the developing bias Vb2, any of various known biases is applicable, and a bias in which an AC voltage is superposed on a DC voltage is applied in general.

Then, the toner layer (post-development residual toner layer) from which toner has been consumed in the second developing area 9 is conveyed, with the rotation of the second toner carrier 16, to the second toner supplying area 10, and as mentioned above, the toner will be collected by the developer carrier 11.

The developer 23 that passed through the second toner supplying area 10 is further conveyed toward the developer tank 17 with the rotation of the sleeve roller 12, and the developer 23 is then separated from the developer carrier 11 to be collected into the developer tank 17 by the repulsing magnetic field formed by the magnetic poles N2 and N3 of the magnet body 13.

When a replenishment controller (not shown) detects, based on the output value of the ATDC sensor 21, that the toner concentration in the developer 23 becomes lower than the minimum toner concentration for ensuring the sufficient image density, the supply toner 22 stored in the hopper is supplied, by the toner supply section (not shown), into the developer tank 17 through the supply section 24.

(Decrease in Toner Supplying Ability to Downstream-Side Toner Carrier)

Here will be described the phenomenon, in a hybrid development device using a plurality of toner carriers, that the toner supply ability to the downstream-side second toner carrier in the downstream direction in the rotating direction of the developer carrier is decreased depending on the history of supplying toner to the first toner carrier.

Figure 2:
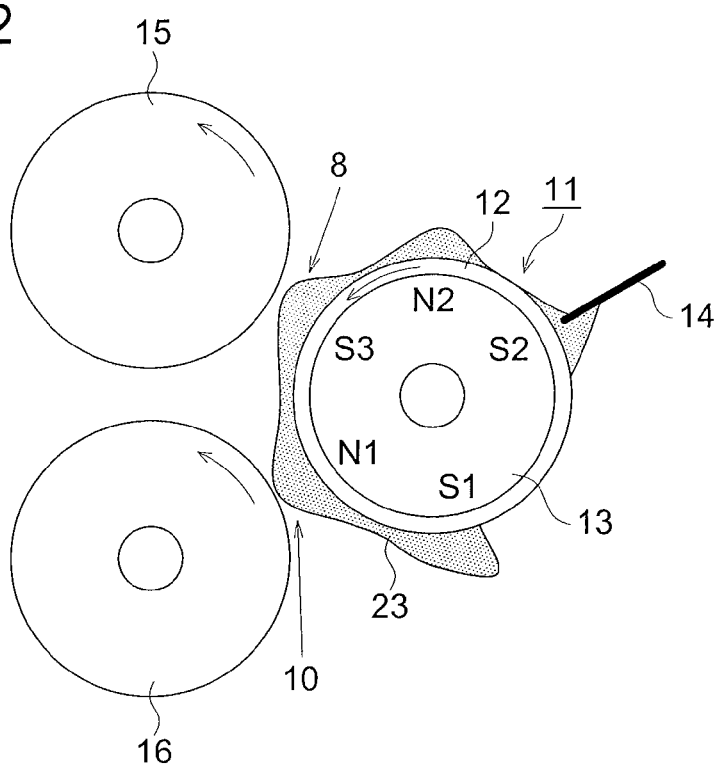
PRIOR ART FIG. 2
FIG. 2 is a diagram showing in detail toner supply areas 8 and 10 of a conventional hybrid development device which has two or more toner carriers.

FIG. 2 is a diagram showing in detail the vicinity of the toner supply areas 8 and 10 of the commonly used conventional hybrid development device which has a plurality of toner carriers 15 and 16. In FIG. 2, although the magnetic body 13 of the developer carrier 11 has the main pole N1 and S3 in the area corresponding to the toner carriers 15 and 16, respectively, it has no magnetic pole between the main magnetic poles.

Figure 3:
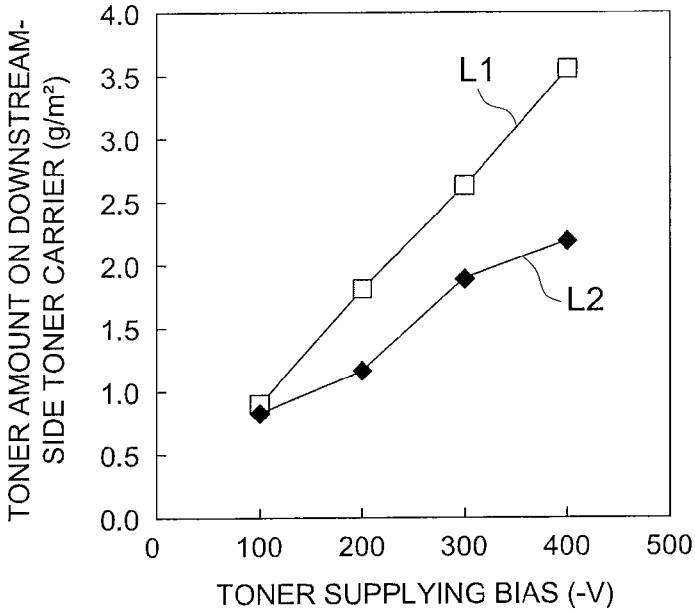
PRIOR ART FIG. 3
FIG. 3 is a graph showing toner supplying ability to a downstream-side toner carrier in the cases where the toner supply to an upstream-side toner carrier is performed or not performed, in the development device of FIG. 2.

FIG. 3 is a graph showing the result of an experimental confirmation, conducted by using the developer carrier 11, of the effect given to the toner supplying ability to the downstream-side toner carrier 16 in two cases: the case where the upstream-side toner carrier 15 is supplied with toner, and the case where the upstream-side toner carrier 15 is not supplied with toner.

In the experiment, the toner supplying ability to the downstream-side toner carrier 16 was measured, by using the conventional development device of FIG. 2, in the two cases: where the upstream-side toner carrier 15 exists, and where the upstream-side toner carrier 15 does not exist.

In FIG. 3, L1 shows the toner supplying ability to the downstream-side toner carrier 16 in the case where the upstream-side toner carrier 15 does not exist, and L2 represents the case where the upstream-side toner carrier 15 exists.

As shown in FIG. 3, the toner supplying ability (L2) to the downstream-side toner carrier 16 is greatly decreased in the case where the upstream-side toner carrier 15 exist, comparing to the toner supply ability (L1) in the case where only the downstream-side toner carrier 16 exists and the history of the toner supply to the upstream-side toner carrier 15 does not occur.

There can be three reasons:

1. The decrease in toner concentration in the developer 23 on the developer carrier 11 caused by the toner supply to the upstream-side toner carrier 15 causes the decrease of the toner supplying ability to the downstream-side toner carrier 16.

2. The consumption of toner, in the surface portion on the developer 23 on the developer carrier 11, caused by supplying toner to the upstream-side toner carrier 15 causes the decrease of the toner supplying ability to the toner carrier on the downstream-side (see FIGS. 4*a* and 4*b*).

Figure 5A:
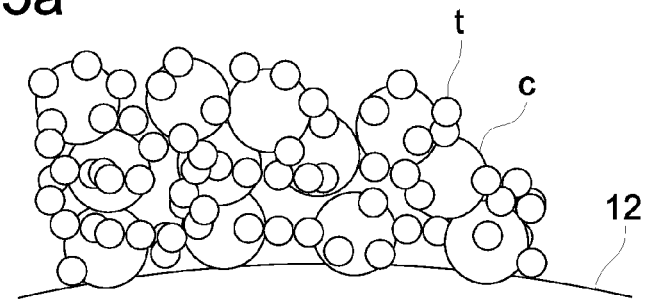
FIG. 5*a* is a pattern diagram showing the state (charge distribution) of the developer before the toner is supplied to the toner carrier.

3. The counter charge in the developer 23 generated by toner being supplied to the upstream-side toner carrier 15 cancels the toner supply bias, thereby reducing the toner supplying ability to the downstream-side toner carrier 16 (see FIGS. 5*a* and 5*b*).

Each reason will be described in detail.

Regarding reason 1, it is apparent that since a certain amount of toner is carried on the developer carrier 11 and a part of toner in the developer is supplied to the toner carrier 15, the toner amount in the developer is reduced.

Regarding reason 2, if consideration is given to from which part of the developer layer the toner is supplied, the reason can be understood.

Figure 4A:
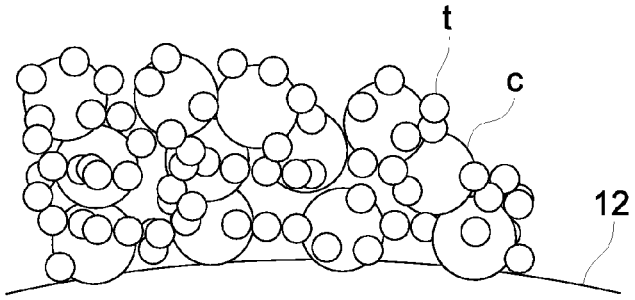
FIG. 4*a* is a pattern diagram showing the state (toner distribution) of a developer before the toner is supplied to the toner carrier.
Figure 4B:
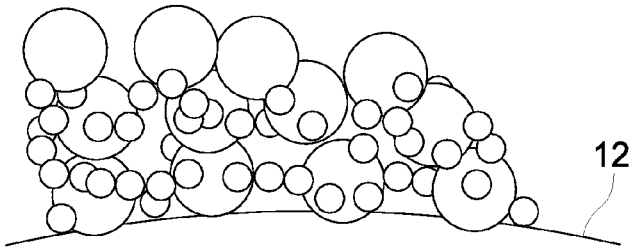
FIG. 4*b* is a pattern diagram showing the state (toner distribution) of the developer after the toner is supplied to the toner carrier.

As shown in FIG. 4*a*, in the developer before the toner supply, toner t and carrier c are well mixed, and the toner t is dispersed evenly in the developer layer. When the toner t is supplied to the toner carrier 15, the toner t on the closer side to the toner carrier 15 is mainly supplied to the toner carrier 15, thus the distributions of toner t and carrier c is changed and whereby toner t gets thin in the vicinity of the surface of the developer.

When toner t is supplied from such developer layer, the toner supplying ability is low because of thinly existing toner t in the vicinity of the developer layer surface. Such phenomenon is significant especially in the case where the resistance of the carrier c is small, because the toner supply bias electric field works mainly on the vicinity of the developer layer surface.

Figure 5B:
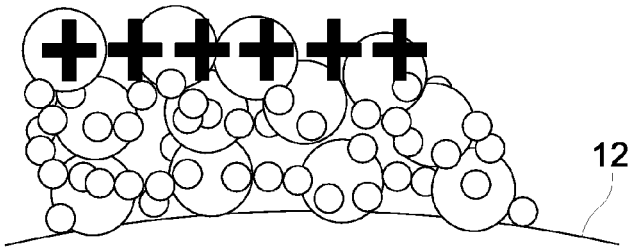
FIG. 5*b* is a pattern diagram showing the state (charge distribution) of the developer after the toner is supplied to the toner carrier.

Regarding reason 3, when the toner t is negatively charged, the developer layer is in the state (shown in FIG. 5*a*) before the toner supply. In contrast, after the toner supply, the negatively charged toner t having been supplied to the toner carrier, the developer is in the state where the charge of opposite polarity (counter charge), which is opposite to the polarity of the toner t, is left as shown in FIG. 5*b*.

When the toner t is supplied from such developer layer, the effective toner supply bias is reduced with a part of the toner supply bias canceled by the counter charge on the developer layer, and whereby the toner supplying ability is reduced. When the resistance of the carrier c is high or the process speed is high, the effect of the counter charge is significant since the counter charge does not sufficiently decrease in the time period for the counter charge to move from the first toner supply area 8 to the second toner supply area 10.

(Toner Supply Bias and Occurrence of Image-Memory)

If the toner supplying ability to the toner carrier 16 decreases, a greater bias needs to be applied to compensate that decrease, as apparent from FIG. 3. In FIG. 2, in order to supply 2.0 g/m$^2$ of toner to the downstream-side toner carrier 16, for example, a toner supply bias to be applied needs to include extra voltage of about 100V in comparison to the case where the upstream-side toner carrier 15 does not exist.

If the toner supplying bias is enlarged, a force to urge toner against the toner carrier in the toner supply area. In the toner supply area, not only toner is supplied, but the post-development residual toners on the toner carrier, which was not used for development, need to be collected to reset the toner carrier. Therefore, if the post-development residual toner on the toner carrier is not sufficiently collected, the problem of image memory will arise.

<Image Memory (Ghost)>

Figure 6A:
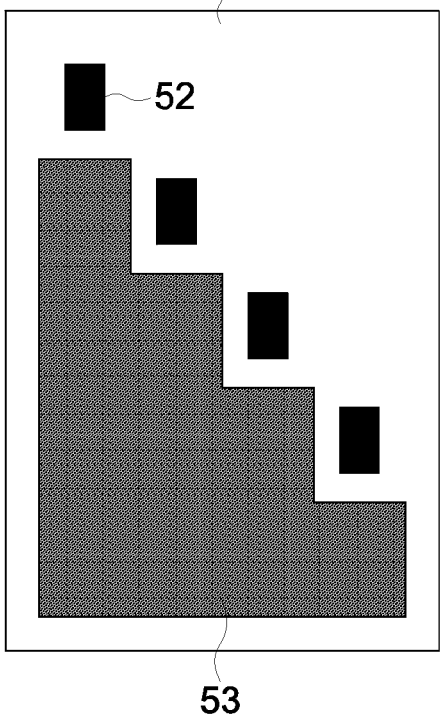
FIG. 6*a* is a diagram showing an example of an image chart used in order to detect a ghost.
Figure 6B:
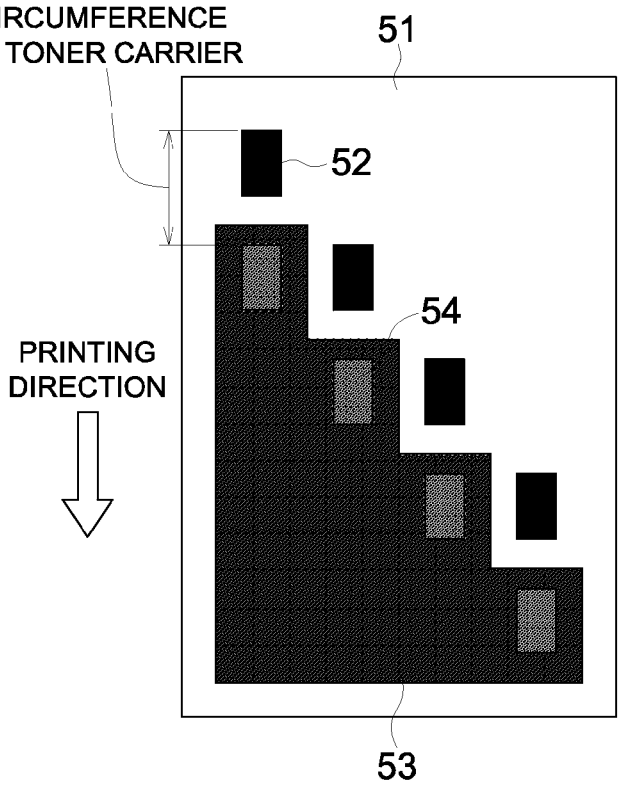
FIG. 6*b* is a diagram showing an example of a printed image in which a ghost has occurred.

Referring to FIGS. 6*a* and 6*b*, the image memory will be described here.

FIG. 6*a* shows an example of an image chart used for detection of ghost. A solid portion 52 and a halftone image portion 53 are arranged in a white portion 51 as a background, as shown in the figure. FIG. 6*b* is a diagram showing an example of a printed image in which an image memory was caused when the image chart in FIG. 6*a* was printed in the print direction shown in the figure.

Image memory (ghost) is the following phenomena.

Assuming that after a high contrast image having the solid portion 52 on the white portion 51 is printed, the halftone image portion 53 is successively printed, as shown in FIG. 6*a*. In that situation, on the outputted printed image, there are patterns 54 in the halftone image portion 53 as shown in FIG. 6*b*, which patterns 54 do not exist in the image chart as an original document but are similar to the solid portion 52. In FIG. 6*b*, the patterns 54, which are ghost, are seen in the halftone image portion 53 at the position following the solid portion 52 with an interval of a circumference of the toner carrier therebetween.

Such a phenomenon originates in the followings.

On the toner carrier immediately after printing a high contrast image pattern, there is left a post-development residual toner corresponding to the printed high contrast image pattern. If the residual toner pattern is not sufficiently removed, an unevenness of toner corresponding to the printed high contrast image pattern is left on the toner carrier even after toner is supplied on the toner carrier.

The unevenness of development property due to the unevenness of the toner layer will create, on the following print image, an unevenness of density (ghost) corresponding to the previously printed pattern. This unevenness of density due to the unevenness of development property is visible to a high extent especially in a halftone image.

Therefore, it is necessary to fully collect the post-development residual toner on the surface of the toner carrier in order to prevent the generation of ghost.

As described above, it can be understood that if the decrease of the toner supplying ability is compensated by raising the toner supplying bias, it will facilitate the image memory to occur.

Therefore, in order to provide a development device 2 in which high speed development is realized by providing a plurality of toner carriers 15 and 16, the advantage created by spreading the burden of toner supplying/collecting is maximized, and image memory does not occur; it is important to recover, as much as possible, the toner supplying ability of the developer layer in which development hysteresis occurred (the toner supplying ability is reduced), before it is conveyed to the second toner supply area.

(Control of Decrease in Toner Supping Ability Using Magnetic Pole S3)

When a consideration is again given to the reasons for the decrease in the toner supplying ability, the reason 1 is not avoidable as long as toner is supplied. However, regarding the reason 2 and 3, the effect of these reasons can be reduced by activating the motion of the developer at somewhere between the first toner supplying area 8 and the second toner supplying area 10.

In the present embodiment, by providing at least one magnetic pole (S3) between the main poles N4 and N1 provided in the toner supplying areas 8 and 10, of the developer carrier 11, facing the respective toner carriers 15 and 16, the effect of the reasons 2 and 3 is reduced.

When a magnetic pole (S3) is provided between the main poles N4 and N1, a bristle of the developer 23 is once made and then falls down while the developer 23 is conveyed from the main pole N4 to the main pole N1. This action operates to homogenize the toner distribution, which is a problem in the reason 2, in which the toner is thin in the vicinity of the surface of the developer layer. In addition, the movement of the developer facilitates the counter charge, which is a problem in the reason 3 and is remaining on the carrier surfaces, to discharge to the sleeve roller 12.

In order to confirm the above effect, the effect that the supply of toner to the upstream-side first toner carrier 15 gives to the toner supplying ability to the downstream-side second toner carrier 16 is measured, in the manner similar to FIG. 3, using the developer carrier 11 in which the pole S3 is provided between the main poles N4 (first magnetic pole) and N1 (second magnetic pole) as shown in FIG. 7, in the development device 2 of FIG. 1. The result is shown in FIG. 8.

Figure 8:
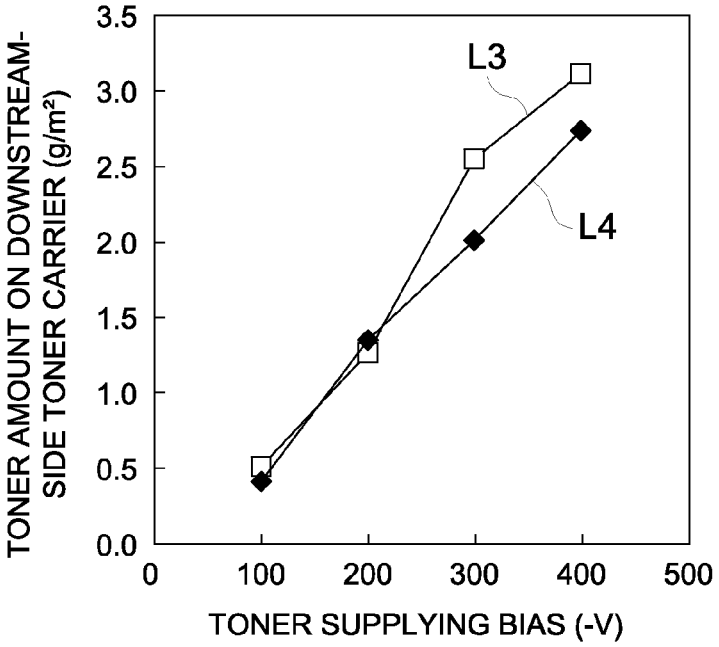
FIG. 8 is a graph showing toner supplying ability to the downstream-side toner carrier in the cases where the toner supply to the upstream-side toner carrier is performed or not performed, in the development device of FIG. 7.

FIG. 8 is a graph showing the result of an experimental confirmation of the effects, given to the toner supplying ability to the downstream-side second toner carrier 16, due to existence and non-existence of the supply of toner to the upstream-side first toner carrier 15 on the upstream side in the rotating direction of the developer carrier 11.

In FIG. 8, L3 shows the toner supplying ability to the downstream-side second toner carrier 16 in the configuration where the upstream-side first toner carrier 15 does not exist, and L4 shows the toner supplying ability to the downstream-side second toner carrier 16 in the configuration where the upstream-side first toner carrier 15 exists.

As shown in FIG. 8, the decrease of the toner supplying ability is improved, compared with FIG. 3, by providing the magnetic pole S3 between the main poles N4 and N1.

In FIG. 7, although only one magnetic pole S3 is provided between the main poles N4 and N1, a plurality of S3 may be provided.

There is no restriction on the magnetic force distribution (profile), and a profile with a plurality of peaks may be used. When only one magnetic pole is provided between the main poles, the magnetic profile has one peak. Alternatively, when a plurality of magnetic poles are provided, the magnetic profile may have a plurality of peaks. With a magnetic force distribution having a plurality of peaks between the main magnetic poles, the movement of the toner being conveyed is activated and made more complex, thereby increasing the effect on improving the decrease in the toner supplying ability.

In order to confirm the suppression of image memory (ghost) due to the above improvement of the toner supplying ability, an image pattern of FIG. 6 was outputted using each of the developer carrier (comparative example) of conventional type with no pole between the main poles and the developer carrier (example) of the embodiment with the pole S3 provided between the main poles. A good image without image memory (ghost) was obtained in the image of the example, but a slight image memory (ghost) was observed in the image of the comparative example.

As mentioned above, in development devices according to the present embodiment using the hybrid development method with a plurality of toner carriers, and in image forming apparatuses using the development device, there is provided a magnetic pole between the main magnetic poles, of the developer carrier, facing both of the toner carriers. In this arrangement, a magnetically raised bristle of developer is moved by the magnetic force while the developer in which toner supply history was occurred on the upstream-side toner supplying area facing the toner carrier on the upstream side in the rotating direction of the developer carrier is conveyed to the downstream-side toner supplying area facing the downstream-side toner carrier, whereby the developer is stirred.

This action reduces the effect that the toner supply history occurred on the upstream side decreases the toner supplying ability on the downstream-side, and the toner supply bias of high voltage is not required, and the ability of collecting post-processing residual toner on the developer carrier is maintained without decreasing.

Thus, the decrease in density at a high speed development is reduced, and a high quality image is obtained with the occurrence of development hysteresis (ghost) reduced.

It should be noted that the above embodiments are for exemplary purpose in all respects, and they are not restrictive thereto. The scope of the invention is not limited to the above descriptions but is defined by the claims of the invention, and is intended to include all modifications in the equivalent meanings and equivalent scope of the claims.

What is claimed is:

1. A development device, comprising:

a first toner carrier and a second toner carrier which are configured to carry toner thereon and to convey the toner to develop with the toner an electrostatic latent image formed on an image carrier; and a developer carrier which is provided facing the first toner carrier and the second toner carrier and is configured to carry thereon developer which contains toner and to supply the toner in the developer to the first toner carrier and the second toner carrier, wherein the developer carrier includes:

a stationarily disposed magnetic body, the magnetic body having:

a first magnetic pole provided to be opposed to the first toner carrier;

a second magnetic pole provided to be opposed to the second toner carrier; and at least a third magnetic pole provided between the first magnetic pole and the second magnetic pole; and a sleeve roller configured to contain the magnetic body therein and to rotate to convey the developer carried thereon.

2. The development device of claim 1, wherein the magnetic body has a magnetic distribution which has a plurality of peaks between the first magnetic pole and the second magnetic pole.

3. An image forming apparatus, comprising:

an image carrier for carrying an electrostatic latent image formed thereon; and a development device for developing the electrostatic latent image on the image carrier, the development device including:

a first toner carrier and a second toner carrier which are configured to carry toner thereon and to convey the toner to develop with the toner the electrostatic latent image on the image carrier; and a developer carrier which is provided facing the first toner carrier and the second toner carrier and is configured to carry thereon developer which contains toner and to supply the toner in the developer to the first toner carrier and the second toner carrier, wherein the developer carrier includes:

a stationarily disposed magnetic body, the magnetic body having:

a first magnetic pole provided to be opposed to the first toner carrier;

a second magnetic pole provided to be opposed to the second toner carrier; and at least a third magnetic pole provided between the first magnetic pole and the second magnetic pole; and a sleeve roller configured to contain the magnetic body therein and to rotate to convey the developer carried thereon.

4. The image forming apparatus of claim 3, wherein the magnetic body has a magnetic distribution which has a plurality of peaks between the first magnetic pole and the second magnetic pole.

* * * * *